United States Patent [19]

Seaquist

[11] Patent Number: 4,685,261

[45] Date of Patent: Aug. 11, 1987

[54] STORM SHUTTER

[76] Inventor: Freddie Seaquist, P.O. Box 4597, Corpus Christi, Tex. 78469

[21] Appl. No.: 718,551

[22] Filed: Apr. 1, 1985

[51] Int. Cl.[4] ..... E06B 9/00

[52] U.S. Cl. ..... 52/202; 52/207; 49/463; 49/62

[58] Field of Search ..... 52/202, 207; 49/463, 49/62

[56] References Cited

U.S. PATENT DOCUMENTS

| | | | |
|---|---|---|---|
| 2,191,500 | 2/1940 | Rosling | 52/202 |
| 2,719,340 | 10/1955 | Best | 52/207 |
| 2,878,536 | 3/1959 | Becker | 49/464 X |
| 3,745,704 | 7/1973 | Covington | 49/463 |
| 4,175,357 | 11/1979 | Goldhaber | 52/202 |
| 4,514,945 | 5/1985 | Menchetti et al. | 52/202 |

*Primary Examiner*—Carl D. Friedman
*Assistant Examiner*—Caroline D. Dennison
*Attorney, Agent, or Firm*—Gunn, Lee & Jackson

[57] ABSTRACT

The invention is a removable translucent and shatter resistant storm shutter removably secured within upper and lower brackets mounted on a window frame. The lower bracket is adaptable to window sills of varying angles due to an adjustable lower angle member.

6 Claims, 11 Drawing Figures

STORM SHUTTER

BACKGROUND OF THE INVENTION

The invention relates to removable storm windows and brackets therefor.

Conventional methods of protecting windows against adverse weather conditions include nailing plywood over the window or covering the window with permanently attached hinged shutters which are swung together over the window when required and are swung apart and decorative in nature when not being used. Further, removable protectable panels are found in U.S. Pat. Nos. 2,568,195; 2,572,764; 2,878,536; 3,745,704; and Canada Pat. No. 687,915. These patents disclose upper and lower brackets mounted adjacent to the window structure and a panel of heavy material held in place between the two brackets to protect the window.

SUMMARY OF THE INVENTION

The invention is a removable translucent and shatter resistant storm shutter. The shutter is removably secured within upper and lower brackets mounted on a window frame. The lower bracket is adaptable for use on window frame with non-horizontal sills by an adjustable lower angle member. The shutter is translucent and shatter resistant.

The apparatus consists of brackets mounted on a window frame and a shutter removably secured therein. One bracket opens downwardly and is mounted on the top of the frame and the other bracket opens upwardly and is mounted on the bottom of the frame. Both brackets are generally U-shaped with a slightly flared outer side to facilitate the installation of the shutter. The bottom bracket has a support member attached to its bottom side which is compressably adjustable to achieve a horizontal relationship between the two brackets regardless of the incline of the sill. When the shutter is inserted into the opening of the upper bracket and elevated to its maximum, the bottom of the shutter easily slips over the flared outer side of the bottom bracket. The shutter is then slid down into the bottom bracket and is securely held in place by both brackets.

The invention has a compressably adjustable support member on the lower bracket which allows the brackets to be mounted horizontally parallel to each other regardless of the window frame construction. The shutter is comprised of a plurality of panels held together in an H-shaped connecting bar which is slidably adjustable into a frame. This construction provides strength to the shutter as well as flexibility and adaptability to join several panels together to protect any size glassed area. Some of the many advantages of this invention include: (1) ease of installation, (2) simplicity of use, (3) permanency of equipment because there are no rubber gaskets or stops to deteriorate, (4) strength of the apparatus, (5) adaptability of the apparatus to any size window, (6) effectiveness in holding the shutter securely in the brackets.

BRIEF DESCRIPTION OF THE DRAWINGS

FIG. 5 illustrates the lower bracket and support member when the window sills are horizontally parallel.

FIG. 6 illustrates the use of the compressible support member when the window sills are slightly in a nonparallel horizontal relationship.

FIG. 7 illustrates the use of the support member when a window sill is at an incline. The angle between the bottom of the lower bracket and the window sill equals the incline of the sill and the angle between the nonparallel horizontal upper and lower window sills. The use of the support member compensates for this difference and adjusts the brackets in to a horizontal parallel relationship.

DETAILED DESCRIPTION OF THE EMBODIMENT

Figure 1:
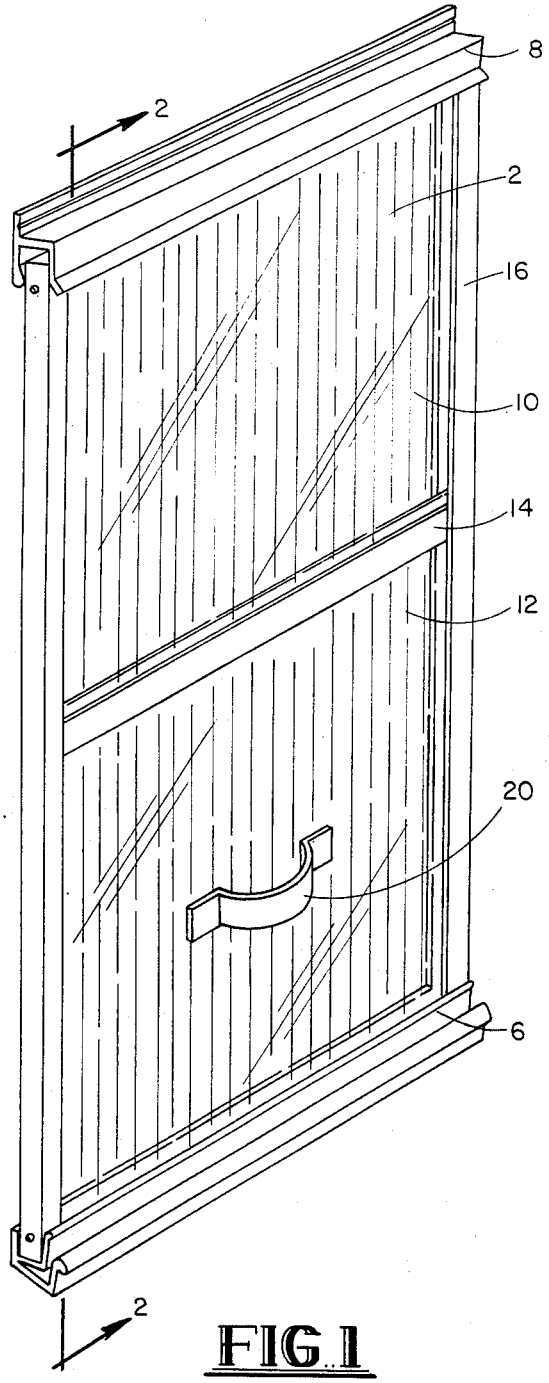
FIG. 1 shows an elevated front view of the invention. The upper and lower brackets and the shutter are removably secured within the brackets. The shutter is constructed of individual translucent panels held in a frame of side molding and by an H-shaped connecting bar.
Figure 2:
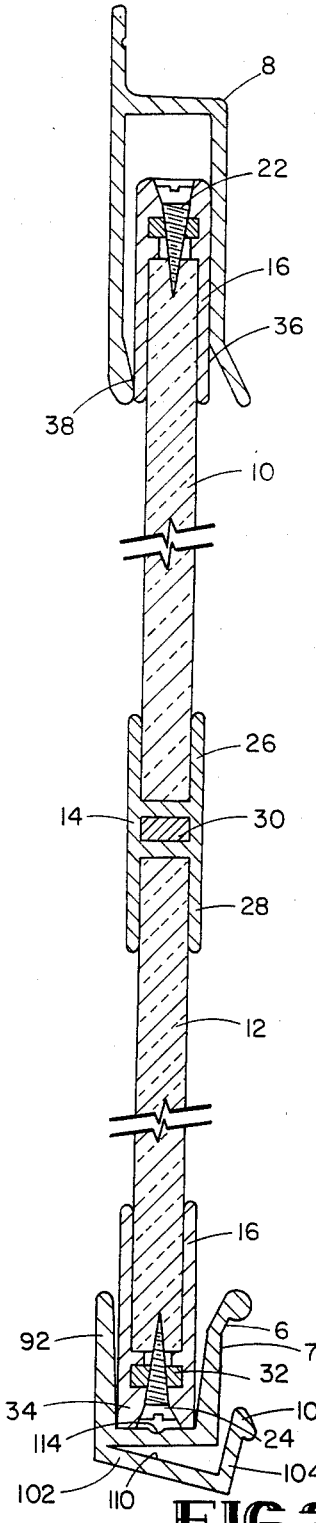
FIG. 2 is a side cut-away view of the invention illustrating placement of the shutter in the upper and lower channel brackets. The individual panels are shown held in the side molding by set screws and in the H-shaped connecting bar.
Figure 3:
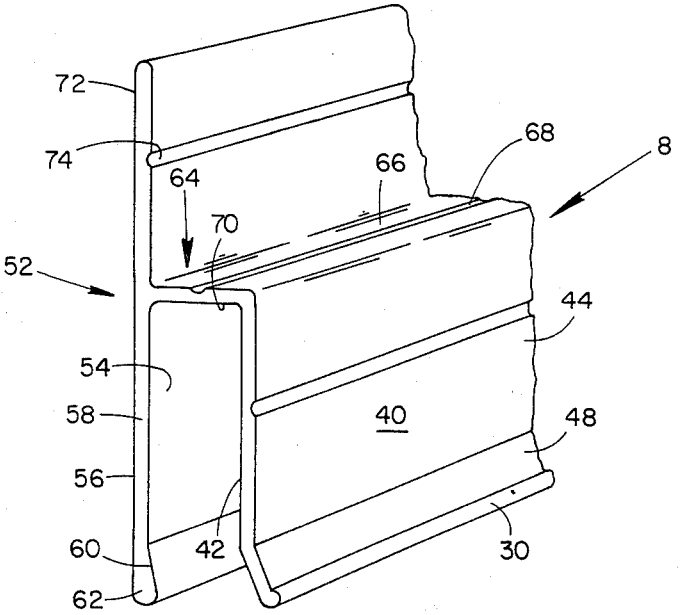
FIG. 3 illustrates the upper bracket. The inner faces of the first side and second side are parallel and are spaced sufficiently apart to accept the shutter between them. The lower portion of the first side is flared outwardly to facilitate insertion of the panel into the bracket. An extension member can be used in mounting the bracket on the outside of the window frame.
Figure 4:
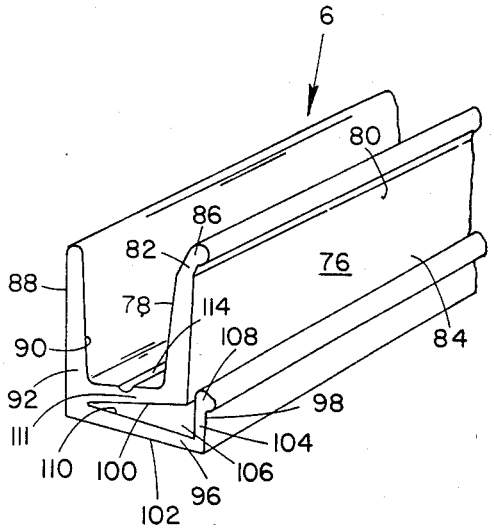
FIG. 4 illustrates the lower bracket. The inner faces of the first and second sides are obtusely placed and spaced sufficiently apart to accept a shutter between them. The upper portion of the first side is slightly flared outwardly to facilitate insertion of the shutter into the bracket. Attached to the lower edge of the bottom side is a support member which is compressibly adjustable when the lower bracket is mounted on the window frame.

Referring now to the drawings in which like reference characters refer to like or similar parts throughout the several views, there is shown in FIG. 1 a storm shutter apparatus embodying one form of the present invention. The storm shutter apparatus includes a translucent and shatter resistant shutter 2, an upper bracket 8 and a lower bracket 6. Shutter 2 is composed of an upper panel 10 and a lower panel 12 held together by a connecting bar 14 and side molding 16. Handle 20 is attached to connecting bar 14 to facilitate installation of shutter 2 into upper bracket 8 and lower bracket 6. Materials to be used in constructing the storm shutter apparatus are only limited by the requirements of strength and flexibility and economy for the particular purpose. Plastic, steel, and wood are all acceptable materials for the shutter as well as for the frame. Shatter resistant shutter 2 if made of plastic, or some translucent material, allows light passage, is noncorrosive and is insulating.

The preferred material for construction of shutter 2 is ½" thick polycarbonate structure sheet in an aluminum channel frame. The preferred structure sheet is a polycarbonate sheet extruded from a grade of polycarbonate with high impact resistance, excellent flame retardance and high clarity. This type of material is commercially available from Polygal U.S.A. Channels run vertically through the sheet aiding the high insulation properties. This type of sheet is very economical for construction of shutter 2 and desirable because it is lightweight, strong, a good insulator, and translucent.

Test results for differential static air pressure applied to the invented storm shutter apparatus are as follows:

| Test Load Pounds/Sq.Ft. | Approximate Wind Velocity Equivalent, MPH | Permanent Deformation, Inches |
|---|---|---|
| 10 | 63 | 0.000 |
| 20 | 89 | 0.002 |
| 30 | 109 | 0.004 |
| 40 | 126 | 0.005 |
| 50 | 141 | 0.009 |
| 60 | 154 | 0.018 |
| 70 | 167 | 0.021 |
| 80 | 179 | 0.147 |
| * | | |
| 80 | 179 | 0.151 |
| ** | | |
| 90 | 189 | 0.152 |
| *** | | |
| 93 | 193 | 0.152 |

The differential static air pressure was applied in 10 psf increments acting in a positive inward direction. Each load was maintained for 10 seconds, removed, and then any permanent deformation recorded. The results of this testing indicated only very slight changes in the storm shutter apparatus.

Shutter 2 is contructed of individual panels, upper panel 10 and lower panel 12. Upper panel 10 and lower panel 12 are fitted into side molding 16 and connecting bar 14. Side molding 16 surrounds the perimeter of panels 10 and 12. Lower set screw 24 and upper set screw 22 secure panels 10 and 12, respectively, within side molding 16. Connecting bar 14 is H-shaped with an upwardly opening channel 26, a downwardly opening channel 28, and angle bar insertion aperture 30. Upper panel 10 is fitted into upwardly opening channel bar 26 and lower panel 12 is fitted into downwardly opening channel bar 28. The structure is held together by angle bar 118, which inserts into angle bar insertion aperture 30 and side molding 16. This configuration permits use of unequally sized structure sheets for upper panel 10 and lower panel 12. It also provides greater rigidity and strength. Connecting bar 14 gives increased structural support to shutter 2.

Shutter 2 is held securely in lower bracket 6 at first and second wedge points 32 and 34 and in upper bracket 8 by third and fourth wedge points 36 and 38. The shortest distance between the first and second sides of upper bracket 8 and lower bracket 6 form wedge points 32, 34, 36, and 38, respectively. Shutter 2 is inserted into upper bracket 8 at a first angle rotated to a second angle and slide downward into bottom bracket 6. Upper portion 8 of first side 76 of lower bracket 6 and lower portion 48 of first side 40 are flared outwardly to facilitate insertion of shutter 2 into brackets 6, 8. The angle of insertion allows panel 2 to pass over first side 76 into upper bracket 8 and slide down into lower bracket 6. Shutter 2 will not rattle when held between first and second wedge points 32 and 34 of lower bracket 6 and first and second wedge points 36 and 38 of upper bracket 8. It is difficult to perfectly align upper bracket 8 and lower bracket 6 in mounting the brackets on the window sills. Because of this nonparallel alignment of the brackets, shutter 2 is held slightly twisted. As a result, the shutter does not rattle.

The combination of these methods to hold shutter 2 securely in place without gaskets or rubberized points overcomes the deterioration problem with use and exposure prevalent in conventional methods.

Upper bracket 8 has a first side 40 with inner face 42, upper portion 44 and lower portion 48. Lower portion 48 is slightly flared to facilitate installation of shutter 2 and has outer support bead 30. Second side 52 of upper bracket 8 has inner face 54 and outer face 56, with upper portion 58 and lower portion 60. Lower portion 60 has inner support bead 62. Top side 64 of the upper bracket 8 has outer face 66 with drill groove 68 and inner face 70. Extension arm 72 with drill groove 74 is an optional means of attachment of upper bracket 8. First side 40 and second side 52 of upper bracket 8 are parallel. Lower portions 48 and 60 of first side 40 and second side 52 are also parallel but at a different angle than upper portions 44 and 58. Wedge points 36 and 38 are formed where lower portion 48 flares from upper portion 44 and inner support bead 62 flares from upper portion 58. This is the shortest distance between first side 40 and second side 52 and securely holds shutter 2 when inserted into upper bracket 8.

Lower bracket 6 has first side 76 with inner face 78, outer face 80, upper portion 82 and lower portion 84. Upper portion 82 has outer support bead 86. Second side 88 has inner face 90 and outer face 92. Lower bracket 6 has support member 94 with bottom leg 96 and upright leg 98. Bottom leg 96 has inner face 100 and outer face 102. Upright leg 98 has outer face 104 with support bead member 108 and inner face 106. Bottom side 110 has outer face 111 and inner face 112 with drill groove 114. Outer face 111 of bottom side 110 forms an angle with inner face 108 of bottom leg 96. The size of the angle depends upon the relative positions of lower bracket 6 and upper bracket 8 when attached to a window sill.

Lower bracket 6 can be adjustably positioned into a horizontally parallel relationship with upper bracket 8 by suport member 94. Support member 94 is sufficiently flexible to bend from 20° to 0° or vice versa, is typically positioned at a 12° angle from the upper bracket and is sufficiently rigid to support shutter 2. Screw means 116 is used to adjust lower bracket 6 to the desired position relative to upper bracket 8 by increasing or decreasing the size angle of support member 94. The greater the window sill incline, the greater support member 94 must be extended. The angle of support member 94 is formed between outer face 111 of bottom side 108 and inner face 100 of bottom leg 96. The size of the angle depends upon the relative position of upper bracket 8 and lower bracket 6 when mounted on the window sill. Drill groove 114 insures proper placement of lower bracket 6 by designating the proper positioning for screw means 116.

Figure 5:
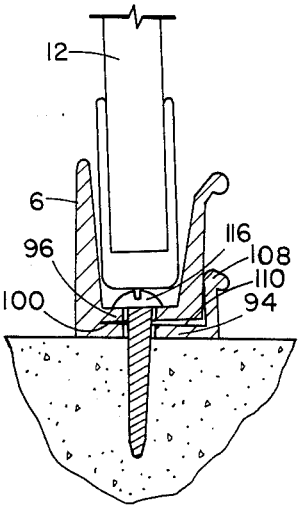
FIGS. 5, 6 and 7 illustrate the shutter secured within the lower bracket and the compressably adjustable support member attached to the lower edge of the bottom side of the lower bracket.
Figure 6:
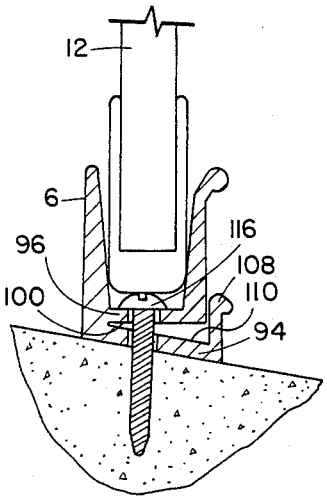
Figure 7:
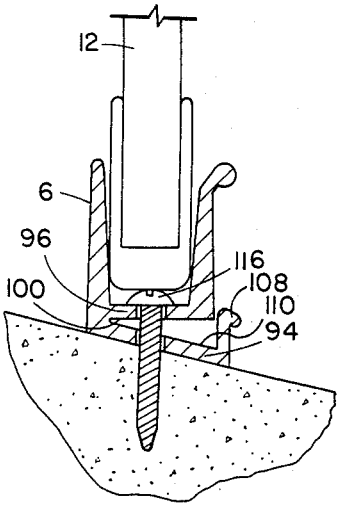
Figure 8:
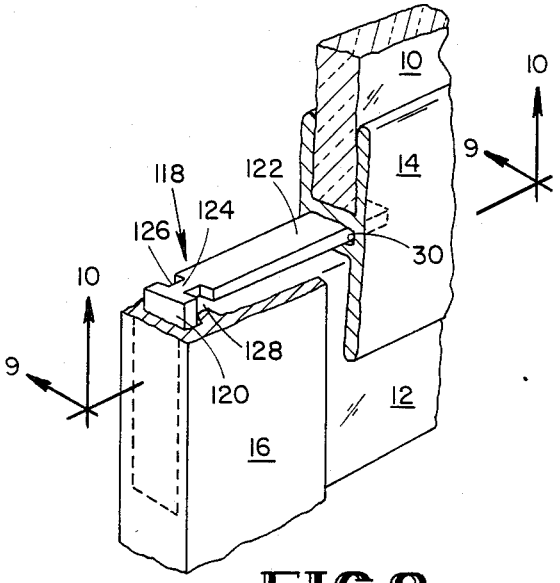
FIG. 8 illustrates the construction of the shutter. The panel sections are held in the H-shaped connecting bar. A notched angle bar with a center support and side support is slidably adjustable into the side molding and connects the panels to the side molding to form a shutter.

The proper positioning of lower bracket 6 relative to upper bracket 8 depending upon the incline configuration of the window frames as illustrated in FIGS. 5, 6, and 7. FIG. 5 illustrates a window frame configuration in which the upper and lower window sills are horizontally parallel. Because of the parallel relationship of the window sills, lower bracket 6 and upper bracket 8 when mounted on the sills are also in a horizontally parallel relationship. Support member 94 is not used in this configuration and outer face 111 of bottom side 108 is flush with inner face 100 of bottom leg 96. It is important that lower bracket 6 and upper bracket 8 are maintained in a horizontally parallel relationship to properly place and secure shutter 2 in upper bracket 6 and lower bracket 8.

FIG. 6 illustrates a window frame configuration in which the relationship of the window sills is at a slight incline. Support member 94 is shown in a position to maintain lower bracket 6 in a horizontal position with upper bracket 8. The size angle formed between outer face 111 of bottom side 108 and inner face 100 of bottom leg 96 depends upon the incline of the window sills. The greater the incline, the greater the size of the angle necessarily required to position the brackets in a horizontal relationship. Screw means 116 is used to make this adjustment by the distance the screw is screwed into the sill.

FIG. 7 illustrates a window frame configuration in which the lower window sill is at a great incline relative to that of the upper window sill. When upper bracket 8 and lower bracket 6 are mounted on such a window frame configuration, the brackets will not be in a proper relationship to permit the shutter to fit in both. Screw means 116 is used to adjust bracket 6 parallel with upper bracket 8. Support member 94 is extended forming a large size angle between outer face 111 of bottom side 108 and inner face 100 of bottom leg 96. Screw means 116 is used to adjust lower bracket 6 with upper bracket 8 by the distance screw means 116 is driven into the lower window sill. This allows for forming a greater size angle between inner face 100 of bottom leg 96 and outer face 111 of bottom side 110.

Angle bar 118 inserts into side molding 16 and connecting bar 14. Angle bar 118 is comprised of side support 120, center support 122 and center bar 124. Center bar 124 has a first notch 126 and a second notch 128. Angle bar 118 is adjustably slidable into angle bar insertion aperture 30 and side molding 16 to secure upper panel 10 and lower panel 12 to side molding 16 and thus form shutter 2. First notch 126 and second notch 128 are sized and shaped to insert side support 120 into side molding 16 and to hold angle bar 118 securely within side molding 16 and connecting bar 14. This configuration provides structural integrity to shutter 2. Since angle bar 118 is slidably adjustable, shutter 2 can be composed of two separate pieces of structure sheet. This is more economical than using large pieces of material and also provides greater structural strength to the shutter 2 overall. The slidably adjustable angle bar 118 also allows use of irregular or mismatched pieces of material in constructing shutter 2.

Figure 9:
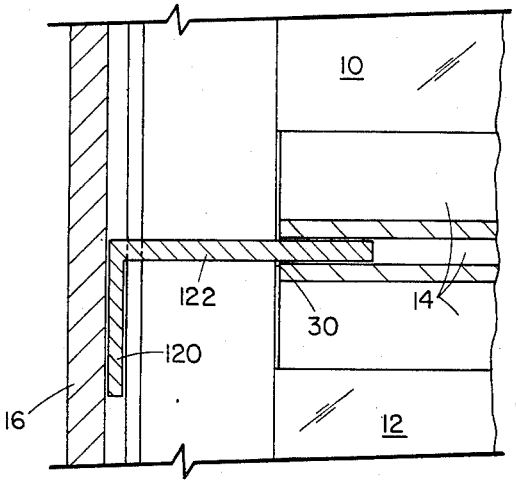
FIG. 9 illustrates the notched angle bar slidably adjustable into the side molding and the connecting bar.
Figure 10:
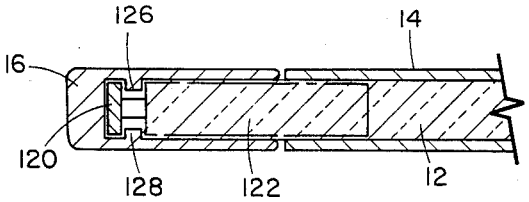
FIG. 10 illustrates a cross-sectional view of the notched angle bar placement into the side molding and the connecting bar.

As illustrated in FIG. 9, angle bar 118 is slidably adjustable into side molding 16 and connecting bar 14 by side support 120 inserting into side molding 16 and center support 122 inserting into angle bar insertion aperture 30 of connecting bar 14. First notch 126 and second notch 128 fit closely within side molding 16 to allow side support 120 to be slidably adjustable within side molding 16.

Figure 11:
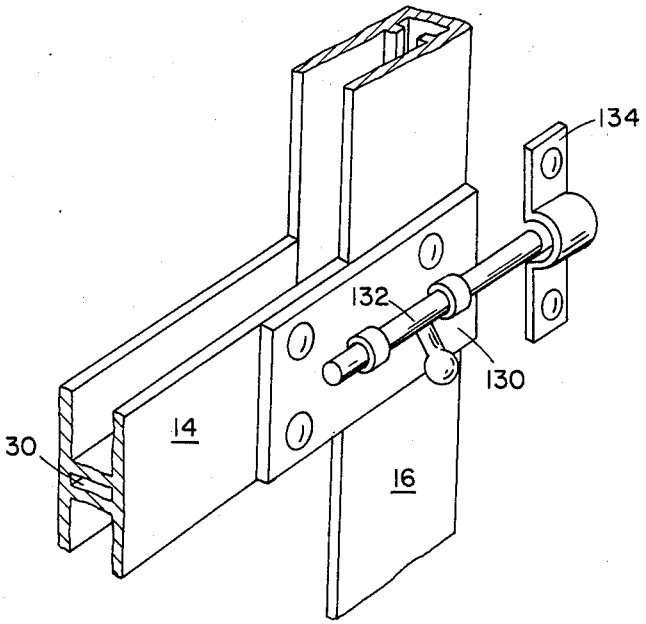
FIG. 11 illustrates a blot attached to the connecting bar and a latch mounted on the window frame which when engaged secures the shutter laterally to the window frame.

The storm shutter apparatus is securely held to the frame of the window by upper and lower brackets being screwed to the window sills. However, for extra security, a blot and latch arrangement can be attached to the shutter apparatus. As illustrated in FIG. 11, a bolt 130 is attached to connecting bar 14 and outer side molding 16 and latch 134 is attached to the frame of the window. By this means, the storm shutter apparatus can be held more securely to the frame of the window. This further prevents rattling or any movement of the storm shutter apparatus. Also, the bolt and latch can be used to permanently secure the storm shutter apparatus to the structure and can be locked. The storm shutter apparatus can be secured to the inside or outside of the window frame to provide greater security to the structure.

While the invention has been described in connection with the preferred embodiment, it is not intended to limit the invention to the particular form set forth, but, on the contrary, it is intended to cover such alternatives, modifications, and equivalents as may be included within the spirit and scope of the invention as defined by the appended claims.

What is claimed is:

1. A shutter apparatus for protection of a window mountable on a window frame comprising:

an upper bracket having a top side, a first side, and a second side, said first side and said second side being connected to said top side, said first and second sides being spaced sufficiently apart to accept a protective shutter and being sufficiently long and sufficiently close together to securely retain said protective shutter between them and being sufficiently strong to hold said protective shutter against perpendicular forces exerted against said protective shutter, said first side having first and second faces, said first face being flared away from said second side to facilitate placement of said protective shutter within said upper bracket, said upper bracket having guide means to facilitate mounting said upper bracket on an upper portion of said window frame, said upper bracket being mountable on said window frame with said upper bracket opening downward;

a lower bracket having a bottom side, a first side and a second side, said first side and said second side being connected to said bottom side, said first and said second sides being spaced sufficiently apart to accept a protective shutter and being sufficiently long and sufficiently close together to securely retain said protective shutter between them and being sufficiently strong to hold said protective shutter against perpendicular forces exerted against said protective shutter, said first side having first and second faces, said first face being flared away from said second side to facilitate placement of said protective shutter within said lower bracket, said lower bracket having a guide means to facilitate mounting of said lower bracket on a lower portion of said window frame, said lower bracket mountable on said window frame with said lower bracket opening upwardly, said lower bracket having an inner face and an outer face and and adjustable support member attached at an acute angle to said outer face of said bottom side for adjusting the orientation of said lower bracket relative to said upper bracket;

a shutter comprised of a rigid material and a frame, said shutter being sized to fit securely within both said upper and lower brackets and being sufficiently strong and shatter resistant to protect said windows.

2. A shutter apparatus for protection of a window mountable on a window frame having an upper bracket, a lower bracket, and a panel comprising:

said upper bracket having a top side, a first side, and a second side, said first side and said second side being connected to said top side, said first and second sides being sufficiently apart to accept a protective shutter and being sufficiently long and sufficiently close together to securely retain said protective shutter between them and being sufficiently strong to hold said protective shutter against perpendicular forces exerted against said protective shutter;

said lower bracket having a bottom side, a first side and a second side, said first side and said second side being connected to said bottom side, said first and second sides being sufficiently apart to accept a protective shutter and being spaced sufficiently long and sufficiently close together to securely retain said protective shutter between them and being sufficiently strong to hold said protective shutter against perpendicular force exerted against said protective shutter, said lower bracket mountable on said window frame with said lower bracket opening upwardsly, said bottom side of said lower bracket having an inner face and an outer face, a support member attached at an acute angle to said outer face of said bottom side, a fastener means positioned through said bottom side and said support member for fastening said bottom means to said window frame and compressing said bottom means against said window frame, said support member sufficiently rigid to resist change in the orientation of said lower bracket on said window frame and sufficiently flexible to permit the orientation of said bottom side to be adjusted by compressing said bottom side against said window frame by said fastener means to permit said shutter to be removably secured within both said upper and lower brackets;

a shutter comprised of a translucent material and a frame, said shutter being sized to fit securely within both said upper and lower brackets and being sufficiently strong and shatter resistant to protect said windows.

3. The invention of claim 2 further comprising a fastener means used for accurate placement and affixation of said lower bracket to said window frame, said fastener means passing through said drill groove on said bottom side and passing through said support member to secure said lower bracket to said window frame, said fastener means used to adjust said angle between an inner face and an outer face of said bottom side in orientating said lower bracket relative to said upper bracket on said window frame.

4. A shutter apparatus for protection of a window mountable on a window frame comprising:

said upper bracket having a top side, a first side, and a second side, said first side and said second side being connected to said top side, said first and second sides being spaced sufficiently apart to accept a protective panel and being sufficiently long and sufficiently close together to securely retain said protective shutter between them and being sufficiently strong to hold said protective shutter against perpendicular forces exerted against said protective panel, said first side having first and second faces, said first face being flared away from said second face to facilitate placement of said protective panel within said upper bracket, said upper bracket having guide means for mounting said upper bracket on an upper portion of said window frame, said upper bracket being mountable on said window frame with said upper bracket opening downward, said panel being securely held within said upper bracket and said lower bracket by wedge points formed at the shortest distance between said first side and said second side of said upper and said lower bracket;

said lower bracket having a bottom side, a first side and a second side, said first side and said second side being connected to said bottom side, said first and second sides being spaced sufficiently apart to accept a protective shutter and being sufficiently strong to hold said protective shutter against perpendicular forces exerted against said protective shutter, said lower bracket mountable on said window frame with said lower bracket opening upwardsly, said bottom side of said lower bracket having an inner face and an outer face, a support member attached at an acute angle to said outer face of said bottom side, a fastener means positioned through said bottom side and said support member fastening said bottom means to said window frame and compressing said bottom means against said window frame, said support member sufficiently rigid to resist change in the orientation of said lower bracket on said window frame and sufficiently flexible to permit the orientation of said bottom side to be adjusted by compressing said bottom side against said window frame by said fastener means to permit said shutter to be removably secured within both said upper and lower brackets;

a shutter comprised of a translucent material, said shutter being sized to fit securely within said upper and lower brackets and protect said windows, said shutter being sufficiently strong and shatter resistant to protect said windows, said shutter comprised of individual panels secured together by a connecting bar and a frame, said connecting bar comprised of an upwardsly opening channel and a downwardsly opening channel, said individual panels secured within said channels, said connecting bar slidably adjustable within said frame to form said shutter sized to protect any size window.

5. The invention of claim 4 wherein said shutter apparatus is secured to a window frame by a bolt and latch, said bolt and latch secures said shutter apparatus to said window frame and can be locked.

6. The invention of claim 4 wherein said shutter has an upper portion and a lower portion held together by a channel bar, side molding and an angle bar, said angle bar is adjustably insertable into said side molding and said connecting bar for construction of said shutter with non-uniform sized pieces of material.

* * * * *